US009263803B1

(12) United States Patent
Weller et al.

(10) Patent No.: US 9,263,803 B1
(45) Date of Patent: Feb. 16, 2016

(54) MECHANICALLY RECONFIGURABLE ANTENNAS

(71) Applicants: Thomas McCrea Weller, Lutz, FL (US); Ibrahim Turki Nassar, Tampa, FL (US); Craig Perry Lusk, Lutz, FL (US)

(72) Inventors: Thomas McCrea Weller, Lutz, FL (US); Ibrahim Turki Nassar, Tampa, FL (US); Craig Perry Lusk, Lutz, FL (US)

(73) Assignee: University of South Florida, Tampa, FL (US)

( * ) Notice: Subject to any disclaimer, the term of this patent is extended or adjusted under 35 U.S.C. 154(b) by 253 days.

(21) Appl. No.: 14/077,653

(22) Filed: Nov. 12, 2013

Related U.S. Application Data

(60) Provisional application No. 61/724,418, filed on Nov. 9, 2012.

(51) Int. Cl.
*H01Q 1/38* (2006.01)
*H01Q 19/00* (2006.01)

(52) U.S. Cl.
CPC ..... *H01Q 19/005* (2013.01); *H01Q 1/38* (2013.01)

(58) Field of Classification Search
CPC ..... H01Q 19/005; H01Q 1/38; H01Q 9/0407
USPC ..... 343/700 MS, 893, 882, 833, 834
See application file for complete search history.

(56) References Cited

U.S. PATENT DOCUMENTS

| | | | | |
|---|---|---|---|---|
| 5,835,062 | A * | 11/1998 | Heckaman | H01Q 1/26 343/700 MS |
| 6,008,773 | A * | 12/1999 | Matsuoka | H01Q 19/108 343/700 MS |
| 6,198,438 | B1 | 3/2001 | Herd et al. | |
| 7,330,152 | B2 | 2/2008 | Zhang et al. | |
| 7,388,543 | B2 * | 6/2008 | Vance | H01Q 1/243 343/700 MS |
| 7,423,593 | B2 | 9/2008 | Puente Baliarda et al. | |
| 7,453,413 | B2 | 11/2008 | Larry et al. | |
| 8,334,810 | B2 * | 12/2012 | Foo | H01Q 1/42 343/700 MS |
| 2009/0207091 | A1 | 8/2009 | Anagnostou et al. | |

OTHER PUBLICATIONS

Fan Yang; Rahmat-Samii, Y.; , "A reconfigurable patch antenna using switchable slots for circular polarization diversity," Microwave and Wireless Components Letters, IEEE , vol. 12, No. 3, pp. 96-98, Mar. 2002.

Ung, Y.J.; Jang, T.U.; Kim, Y.-S.; , "A reconfigurable microstrip antenna for switchable polarization," Microwave and Wireless Components Letters, IEEE , vol. 14, No. 11, pp. 534-536, Nov. 2004.

Faist "Parametric Study on the use of Hoberman Mechanisms for Small Satellite Reconfigurable Solar and Antenna Arrays", Aerospace Conference, 10:1-8, IEEE, 2010.

Nassar, et al. "Radiating Shape-Shifting Surface Based on a Planar Hoberman Mechanism", IEEE, 1-4, 2011.

Sung, et al. "A Reconfigurable Microstrip Antenna for Switchable Polarization", IEEE Microwave and Wireless Components Letters, 14(11):534-536, 2004.

(Continued)

*Primary Examiner* — Hoanganh Le
(74) *Attorney, Agent, or Firm* — Thomas | Horstemeyer, LLP

(57) ABSTRACT

In some embodiments, a mechanically reconfigurable antenna includes a patch antenna, one or more parasitic patches, and a radially foldable linkage associated with the patch antenna that can be actuated to move the parasitic patches radially inward and radially outward relative to the patch antenna to change an electromagnetic property of the antenna.

20 Claims, 10 Drawing Sheets

(56) References Cited

OTHER PUBLICATIONS

Bernhard, et al., "A Smart Mechanically Actuated Two-Layer Electromagnetically Coupled Microstrip Antenna with Variable Frequency, Bandwidth, and Antenna Gain", IEEE Transactions on Antennas and Propagation, vol. 49, No. 4, Apr. 2001.
Haridas, et al. "Reconfigurable MEMS Antennas", NASA/ESA Conference on Adaptive Hardware and Systems, IEEE Computer Society, Jun. 2008.
Lai, et al., "Design of Reconfigurable Antennas Based on an L-Shaped Slot and PIN Diodes for Compact Wireless Devices", IET Microw. Antennas Propag, 2009, vol. 3, Issue 1.
Mazlouman, et al., "Pattern Reconfigurable Square Ring Patch Antenna Actuated by Hemispherical Dieletric Elastomer", Electronic Letters, Feb. 2011, vol. 47, No. 3.
Patel, et al., "A Kinematic Theory for Radially Foldable Planar Linkages", International Journal of Solids and Structures 44 (2007).
Zade, et al., "Modeling and Designing of Circular Microstrip Antenna for Wireless Communication", Second International Conference on Emerging Trends in Engineering and Technology, IEEE Computer Society, 2009.
Mazlouman, et al. "Mechanically Reconfigurable Antennas Using Electro-Active Polymers (EAPs)", Proc. IEEE Int. Symp. Antennas on Propagation and USNC/URSI, Jul. 2011.

* cited by examiner

MECHANICALLY RECONFIGURABLE ANTENNAS

CROSS-REFERENCE TO RELATED APPLICATION(S)

This application claims priority to U.S. Provisional Application Ser. No. 61/724,418, filed Nov. 9, 2012, which is hereby incorporated by reference herein in its entirety.

STATEMENT REGARDING FEDERALLY SPONSORED RESEARCH OR DEVELOPMENT

This invention was made with government support under grant/contract number CMMI-1053956 awarded by the NSF CAREER and ECCS-0925929 awarded by the NSF. The government has certain rights in the invention.

BACKGROUND

Reconfigurable microwave antennas are of interest in many applications, providing multi-band, secure, and/or anti-jam communications capability. The primary benefit of such antennas is that multifunctional operation is included in a single design, therefore providing the potential for reduced system size, weight, and cost. Fundamentally, the reconfiguration can be achieved by physical and/or electrical modifications made to the antenna, or by using an impedance matching network that is connected to the antenna. The parameters that may be altered include the operating frequency, radiation pattern, polarization, and beam direction. For example, tuning of the resonant frequency of antennas has been demonstrated using diodes, micro-electro-mechanical systems (MEMS), and tunable materials.

In addition to increasing antenna complexity, these techniques may restrict the operational bandwidth and degrade the overall communication performance of the antenna because of the added loss and potential non-linearity induced upon the radio frequency (RF) signal. Some innovative approaches have been proposed to create mechanically reconfigurable antennas in order to lower cost and improve the tunability range. Unfortunately, these approaches generally suffer from the slow speed of the mechanical actuators and their high power consumption.

In view of the above discussion, it can be appreciated that it would be desirable to have improved mechanically reconfigurable antennas.

BRIEF DESCRIPTION OF THE DRAWINGS

The present disclosure may be better understood with reference to the following figures. Matching reference numerals designate corresponding parts throughout the figures, which are not necessarily drawn to scale.

DETAILED DESCRIPTION

Figure 1A:
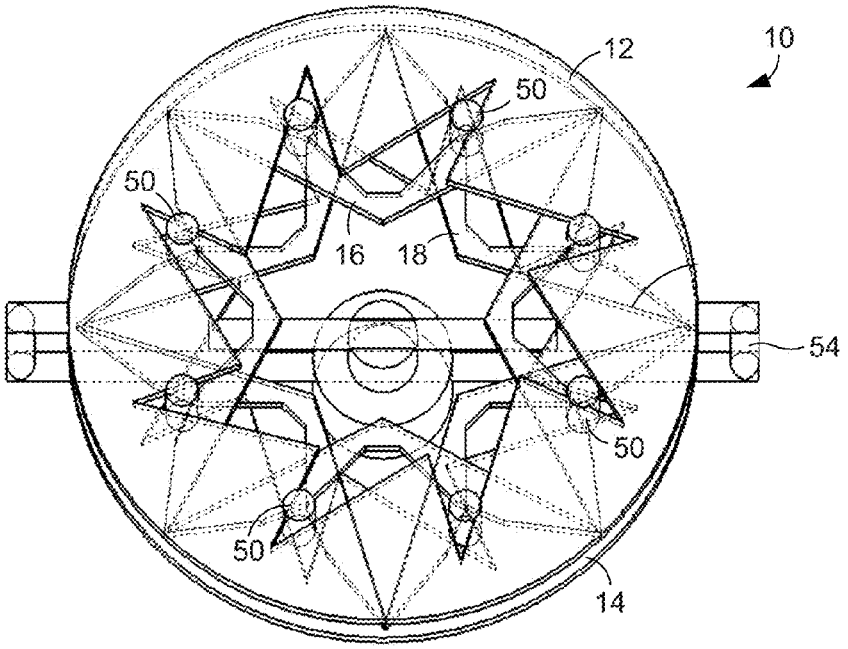
FIGS. 1A and 1B are top perspective views of an embodiment of a planar Hoberman linkage in an uncompressed orientation and a compressed orientation, respectively.

As described above, it would be desirable to have improved mechanically reconfigurable antennas. Described herein are examples of such antennas. In one embodiment, a mechanically reconfigurable antenna includes a radially-foldable linkage that can be used to adjust a circular microstrip patch antenna's operating parameters. In some embodiments, the linkage is a planar Hoberman linkage. Using such a linkage, in which rotation in the $\phi$ direction provides translation in the radial direction, a radiating shape-shifting surface (RSSS) can be developed. In some embodiments, the mechanically reconfigurable antennas incorporate parasitic patches that are repositioned over a fixed microstrip patch antenna and mechanical movement of the parasitic patches using the Hoberman linkage results in tuning of the microstrip patch antenna resonant frequency without degradation of the return loss bandwidth or radiation pattern.

In the following disclosure, various specific embodiments are described. It is to be understood that those embodiments are example implementations of the disclosed inventions and that alternative embodiments are possible. All such embodiments are intended to fall within the scope of this disclosure.

Disclosed herein are mechanically reconfigurable antennas that use foldable mechanisms to change the radiating surface area. Specifically, a planar Hoberman linkage is employed to develop resonant frequency-tunable antennas. FIGS. 1-4 illustrate an example Hoberman linkage 10. As is shown in those figures, the linkage 10 generally includes an upper ring 12 and a lower ring 14 that, as is described below, are used to actuate the linkage. Positioned (sandwiched) between the upper and lower rings 12, 14 are an upper linkage element 16 and a lower linkage element 18.

Figure 4:
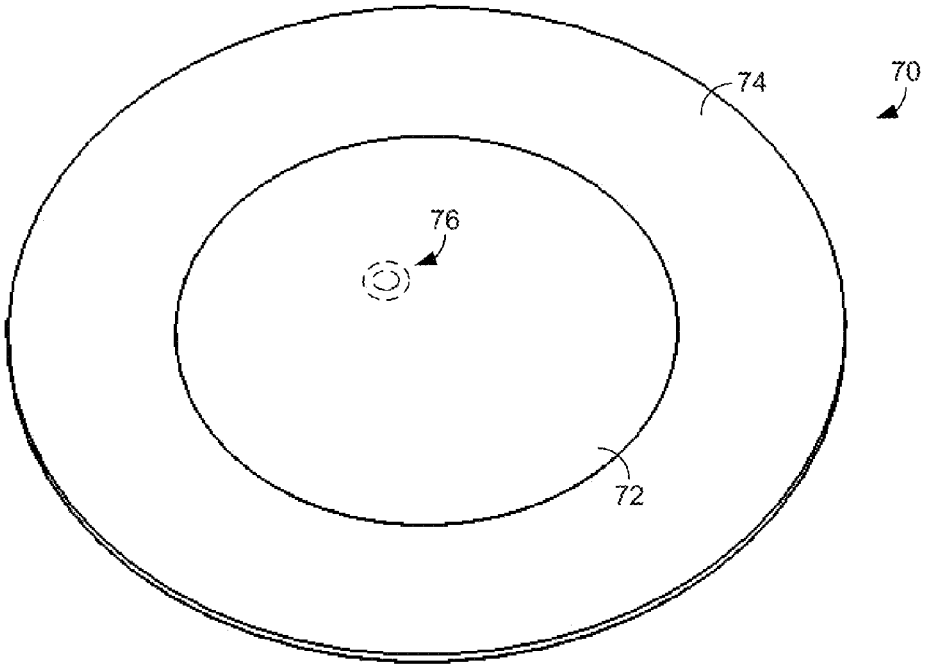
FIG. 4 is a top perspective view of an embodiment of a circular microstrip patch antenna.

The configurations of the upper ring 12, lower ring 14, upper linkage element 16, and lower linkage element 18, and their relative positions within the linkage 10, are shown most clearly in the exploded view of FIG. 4, which only shows these four components of the linkage for clarity. As shown in this figure, the upper and lower rings 12, 14 have similar configurations. More particularly, each ring 12, 14 has a generally circular outer edge 20, 22 and an inner opening 24, 26.

Each opening 24, 26 is star shaped and therefore comprises multiple triangular points 28, 30 that extend outward toward the outer edges 20, 22 of the rings 12, 14. As is apparent from FIG. 3, the tips of the triangular points 28 of the upper ring's opening 24 are slanted toward a clockwise direction, while the tips of the triangular points 30 of the lower ring's opening 26 are slanted toward a counterclockwise direction. Accordingly, the star-shaped inner openings 24, 26 are slanted in opposite directions of each other. In some embodiments, the rings 12, 14 can be substantially identical in configuration, in which case, one of the rings is simply inverted relative to the other ring prior to assembly of the linkage 10. By way of example, the rings 12, 14 each have an outer diameter of approximately 90 mm.

Figure 3:
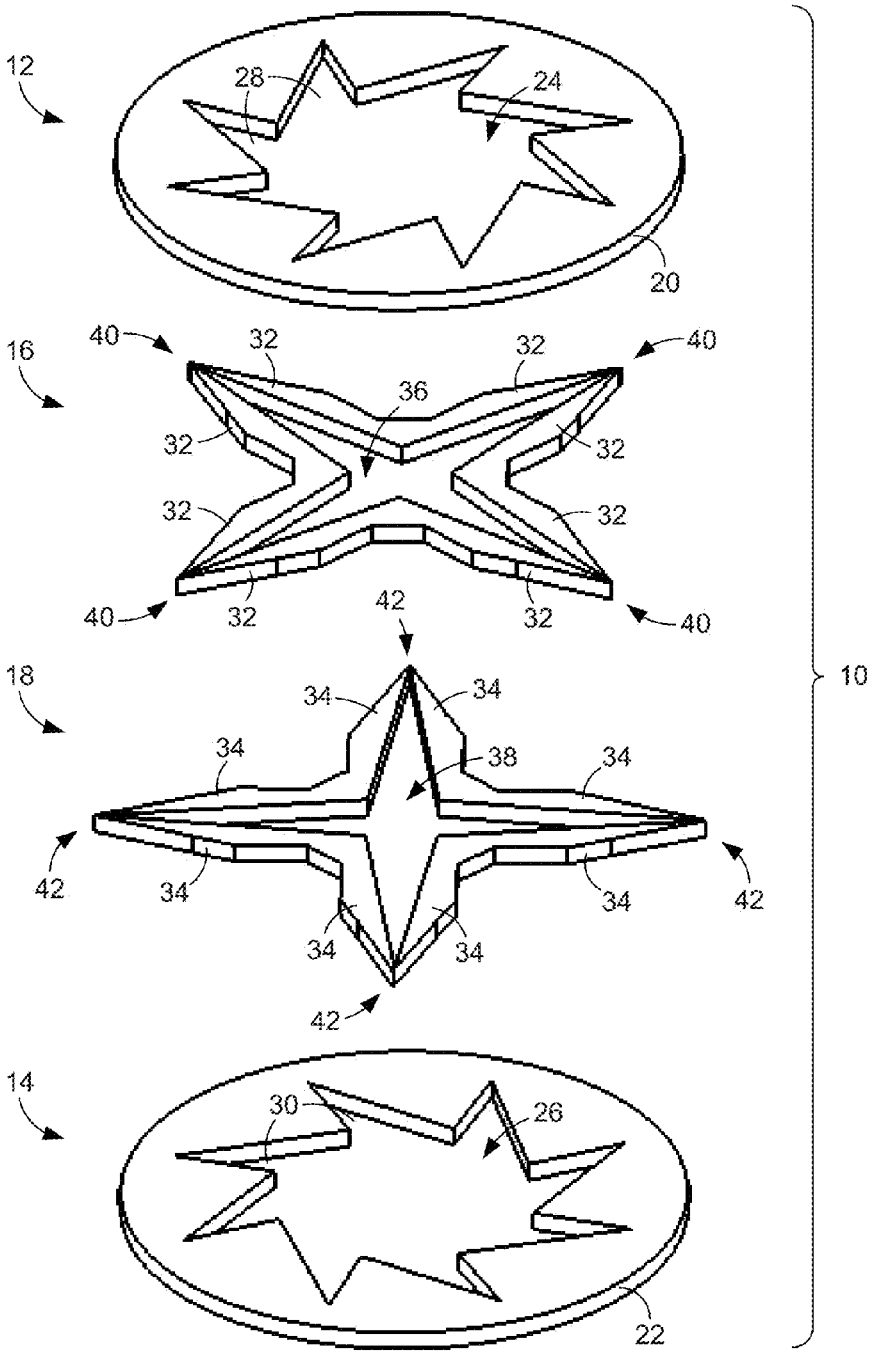
FIG. 3 is an exploded perspective view showing some of the components of the Hoberman linkage of FIGS. 1A and 1B.
Figure 6A:
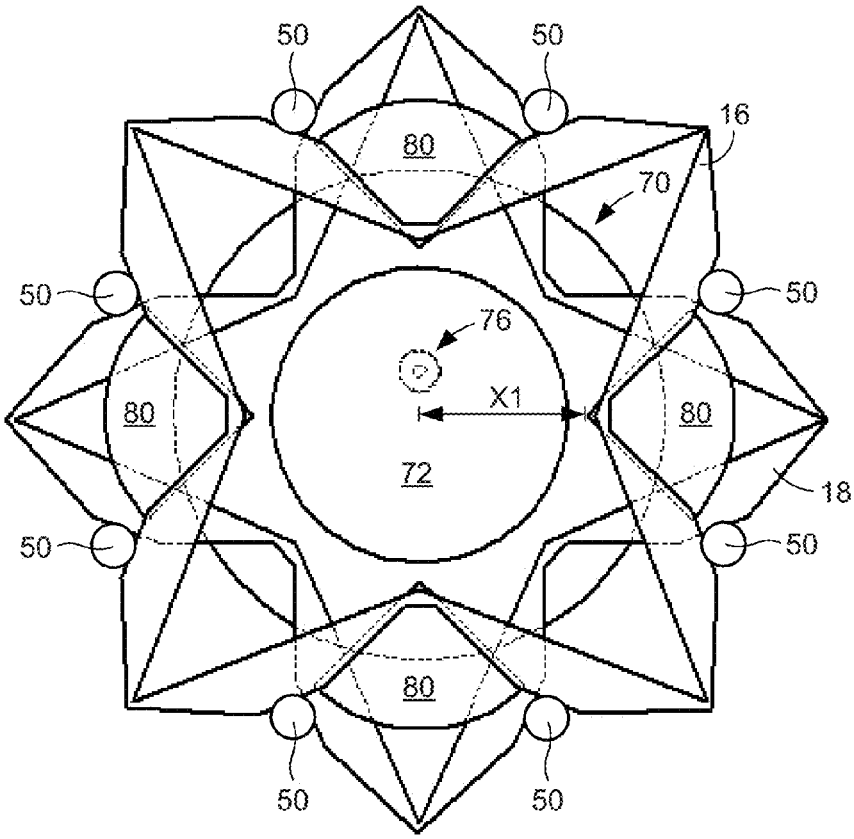
FIGS. 6A and 6B are top views of a first embodiment of a mechanically reconfigurable antenna that uses a Hoberman linkage to adjust the frequency at which the antenna operates.
Figure 6B:
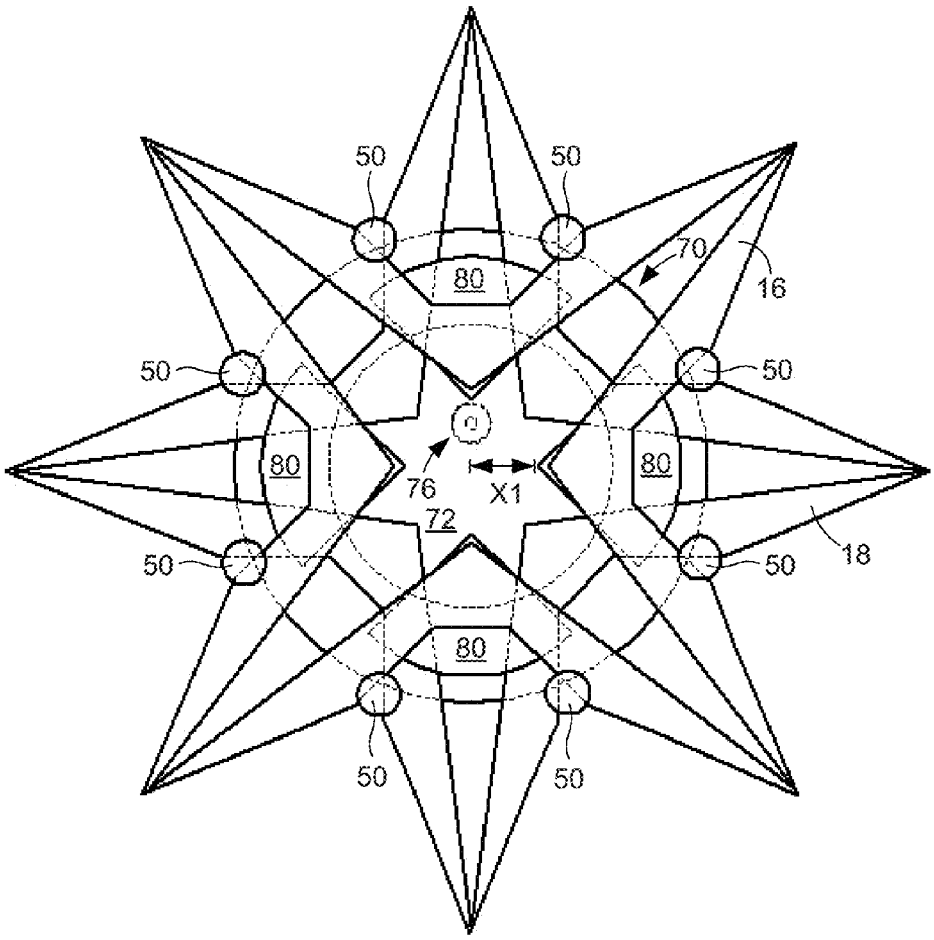

With further reference to FIG. 3, the upper linkage element 16 and the lower linkage element 18 also have similar configurations. That is, each linkage element 16, 18 comprises a body that includes multiple arms 32, 34. The arms 32, 34 are connected to each other in each linkage element 16, 18 so as to define an inner opening 36, 38. In addition, pairs of arms 32, 34 form multiple triangular points 36, 38 that give the linkage elements 16, 18, and the inner openings 36, 38, a star shape. In the illustrated embodiment, each of the linkage elements 16, 18 comprises eight arms 32, 34 that form four triangular points 40, 42. The linkage elements 16, 18 are made of a flexible material, such as a flexible polymeric material, so that the shape of the elements can deform during operation of the linkage 10. An example of this deformation is shown in FIGS. 6A and 6B, which are described below. As with the rings 12, 14, the linkage elements 16, 18 can, in some embodiments, have identical configurations. As indicated in FIG. 3, however, the linkage elements 16, 18 are rotated through 90° relative to each other within the linkage 10 so that their triangular points 36, 38 do not directly overlap.

Figure 1B:
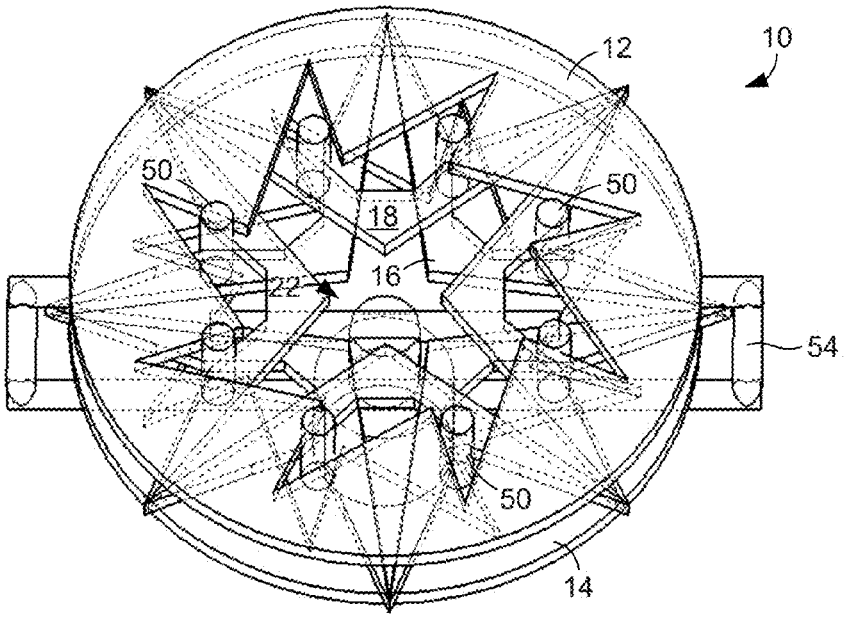
Figure 2:
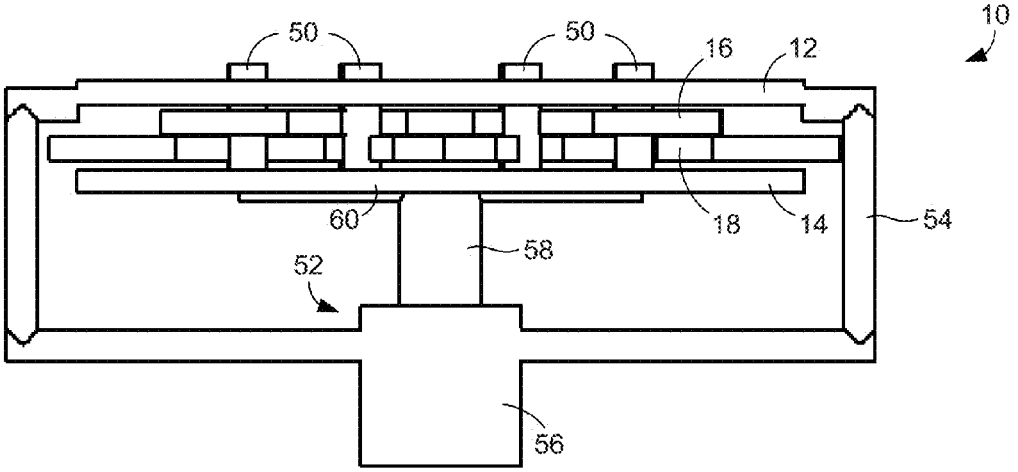
FIG. 2 is a side view of the Hoberman linkage of FIGS. 1A and 1B.

With reference to FIGS. 1 and 2, extending vertically through the upper linkage element 16 and the lower linkage element 18 are multiple pins 50 that connect the two elements. In some embodiments, the pins 50 extend through holes formed in the linkage elements 16, 18. In addition, the pins 50 extend through the inner openings 24, 26 of the upper and lower rings 12, 14. The pins 50 can be driven by the upper or lower ring 12, 14 to actuate the linkage 10. As shown most clearly in FIG. 2, a drive mechanism 52 can be provided to drive one of the rings 12, 14 (in this case the lower ring 14), and a frame 54 can be provided to fix the position of the other ring (in this case the upper ring 12). In illustrated embodiment, the drive mechanism 52 includes a drive motor 56, a drive shaft 58, and a coupling element 60 that connects to the lower ring 14. It is noted that the drive motor 56 can take many different forms. For example, the motor 56 can be an electric motor or a piezo-vibration motor. Alternatively, hydraulic cylinders or shape-memory alloys can be used to obtain the desired actuation.

Because of the star shapes of the inner openings 24, 26 of the rings 12, 14 (see FIG. 3), relative rotation of the upper and lower rings 12, 14 causes the pins 50 to radially move either toward or away from the center of the linkage 10. Specifically, when one of the rings 12, 14 is rotated, the inner edges of the triangular points 28, 30 urge the pins radially inward or outward, depending upon the direction of rotation. Because the pins 50 pass through the upper and lower linkage elements 16, 18, the movement of the pins causes the flexible linkage elements 16, 18 to radially expand or collapse. This phenomenon is illustrated in FIGS. 1A and 1B. As shown in FIG. 1A, the pins 50 are initially positioned radially outward near the outer edges 20, 22 of the upper and lower rings 12, 14. In FIG. 1B, however, the pins 50 have been moved radially inward after rotation of the lower ring 14 by the drive mechanism 52. As a consequence, the upper and lower linkage elements 16, 18 have folded radially inward toward the centers of the upper and lower rings 12, 14. As is described below, when parasitic patches are mounted to one of the linkage elements 16, 18, this radial movement enables adjustment of the electromagnetic parameters of the antenna with which the linkage 10 is used.

Described below are two embodiments of resonant frequency tunable antennas that were designed and tested. Each of these antennas used planar Hoberman linkages similar to that described above. In both embodiments, the antenna comprised a circular microstrip patch antenna that was surrounded by four quarter-circle parasitic patches. By attaching the parasitic patches to the upper linkage element of the Hoberman linkage, the patches could be moved over the circular microstrip patch antenna to vary its operating frequency. The first embodiment uses non-contact electromagnetically coupled parasitic patches and provides greater than 10% frequency tunability. The second embodiment uses electrically coupled parasitic patches that make direct electrical contact with the circular microstrip patch antenna and greater than 26% tuning bandwidth is achieved. Minimal impact on the gain and the 10 dB return loss bandwidth can be achieved with both of the embodiments. In addition, the polarization in both embodiments remains linear over the tuning range.

Figure 5:
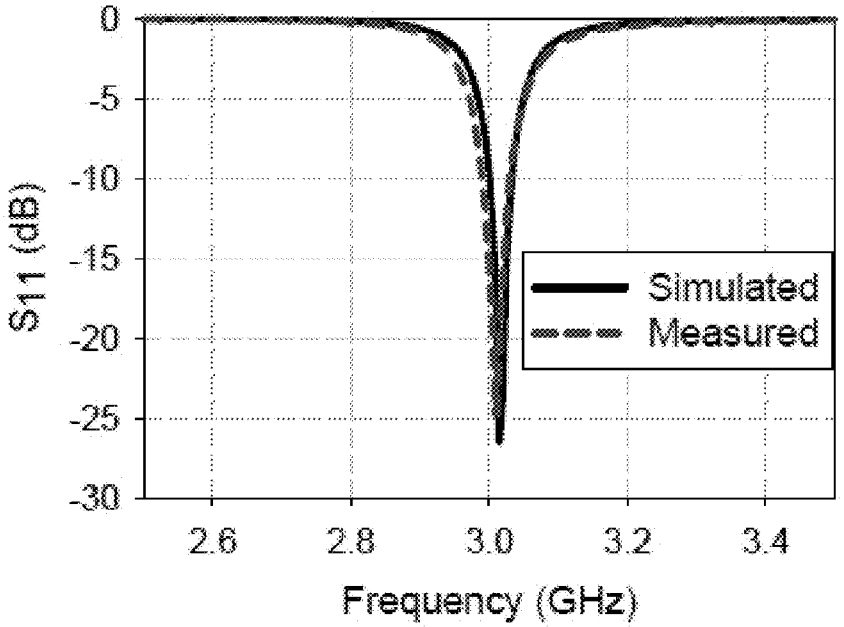
FIG. 5 is a graph of the measured and simulated $S_{11}$ of the antenna of FIG. 4.

FIG. 4 illustrates a circular microstrip patch antenna 70 that can be used as the primary radiating structure in a mechanically reconfigurable antenna. The antenna 70 includes a planar electrically conductive (e.g., metal) circular patch 72 that is formed on a circular dielectric substrate 74. Formed on the opposite side of the substrate 74 is a ground plane (not visible in FIG. 4). The antenna 70 can be treated as a circular cavity that supports modes that are perpendicular to the patch, as with a rectangular microstrip antenna. As shown in FIG. 4, the antenna 70 can be fed from the bottom of the antenna by a coaxial probe 76, which can be positioned so as to match the input impedance to 50Ω. The size of the ground plane on the backside of the substrate 74 can be optimized to reduce the back-side radiation. In experiments that were performed on the design, the substrate 74 comprised a Rogers/RT Duroid 4350 substrate having a nominal relative dielectric constant ($\in_r$) of 3.66 and a thickness (h) of 0.635 mm. The ground plane radius ($R_g$) was 25 mm and the circular patch radius ($R_e$) was 15 mm. The antenna performance was simulated using HFSS software. The simulated and measured $S_{11}$ for the antenna 70 are compared in FIG. 5. As can be appreciated from this figure, the measured and simulated data were well-matched.

Frequency tuning of a circular microstrip antenna such as that illustrated in FIG. 4 can be obtained by adding electromagnetically coupled parasitic patches and using a planar Hoberman linkage to vary their positions relative to the perimeter of the circular microstrip patch antenna. This approach is illustrated in FIGS. 6A and 6B, which show the circular microstrip patch antenna 70 of FIG. 4 positioned between the upper and lower linkage elements 16, 18 illustrated in FIG. 3. Quarter-circle parasitic patches 80 are mounted to the underside of the upper linkage element 16 so as to radially move as the upper linkage element radially expands or collapses. By way of example, the four patches 80 can be held approximately to 0.635 mm above the antenna substrate 74. Each parasitic patch 80 comprises a dielectric substrate (e.g., Rogers/RT Duroid 4350) on which is formed an electrically conductive (e.g., copper) top layer. A distance X1 shown in the figures denotes the distance from the center of the antenna 70 to the vertices of the parasitic patches 80.

The linkage elements 16, 18 were made of a polypropylene material (dielectric constant approximately 2.2) and the pins 50 were made of nylon threaded nuts and bolts. The radius of each parasitic patch ($R_p$) was 15 mm. This symmetrical configuration was selected due to its simplicity and to give more freedom for the mechanical movement without affecting the radiation pattern.

Figure 7:
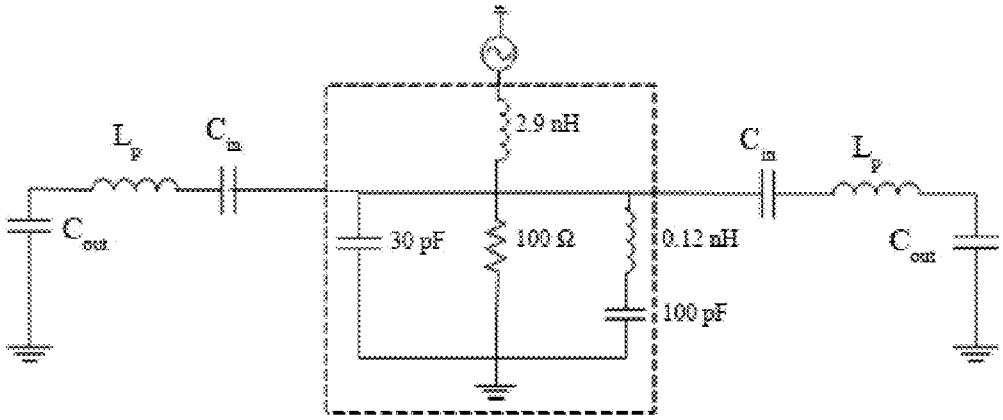
FIG. 7 is a diagram of an equivalent circuit model for a prototype antenna.

An equivalent lumped-element model was developed and simulated using Agilent's Advanced Design Software (ADS), as illustrated in FIG. 7. This model represents the antenna 70 and the two parasitic patches 80 located along the Y-axis. The patches 80 were arranged in the direction of the TM11 mode resonance because of the probe location and because they had the greatest impact on the resonant frequency. The mechanically reconfigurable antenna was mathematically modeled using R, L, and C elements. In FIG. 6, $C_{in}$ represents the coupling capacitance between the parasitic patches and the circular antenna, $C_{out}$ represents the coupling capacitance between the parasitic patches and the ground plane, and $L_p$ represents the inductance of the parasitic patches. Each lumped element value can be calculated as a function of the distance X1 using the following equations:

$$A_{in}=(R_c-X1)^2\times 0.25\times\pi\times 2(m^2), \quad \text{(Equation 1)}$$

$$A_{out}R_p^2\times 0.25\times\pi\times 2-A_{in}(m^2), \quad \text{(Equation 2)}$$

$$W_p\cong 0.25\times\pi\times 2(R_p--X1+3.8\times e^{-3})(m), \quad \text{(Equation 3)}$$

$$C_{in}=\in\times A_{in}/h(F), \quad \text{(Equation 4)}$$

$$C_{out}=\in\times A_{out}/(2\times h)(F), \quad \text{(Equation 5)}$$

$$L_p\cong\mu\times 2\times h\times(R_p-(R_c-X1))/W_p(H) \quad \text{(Equation 6)}$$

where $A_{in}$ is the overlap area between the parasitic patches and the circular patch, $A_{out}$ is the overlap area with the ground, and $W_p$ is the effective parasitic patch width.

Figure 8:
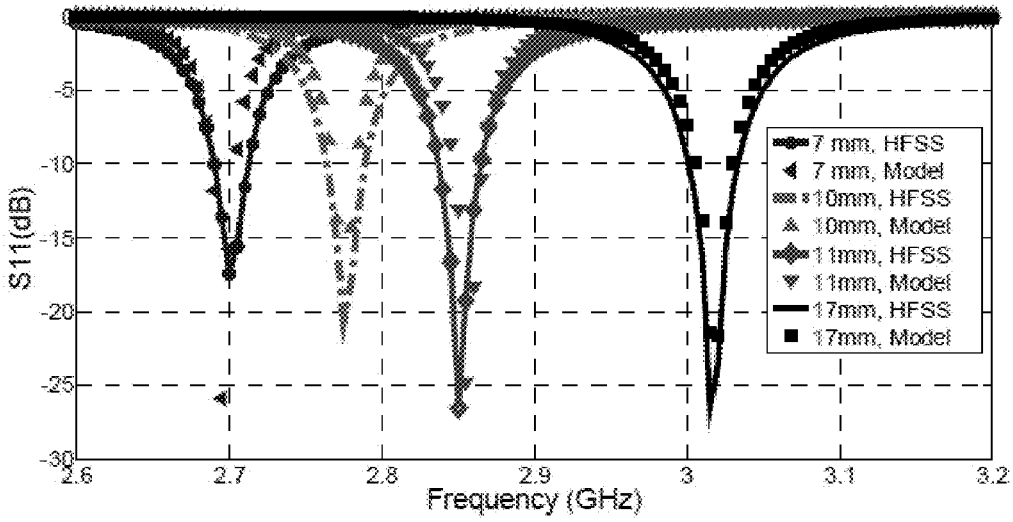
FIG. 8 is a graph of the simulated and modeled $S_{11}$ for the prototype antenna for different X1 values in millimeters (mm).

The change in $S_{11}$, as predicted by the lumped circuit model and the HFSS simulations, are compared in FIG. 8. As can be appreciated from that figure, the model data matched the HFSS results over the entire X1 tuning range. As the parasitic patches moved inward toward the center of the microstrip patch antenna, $C_{in}$ increased and $C_{out}$ decreased due to the corresponding changes in $A_{in}$ and $A_{out}$. $L_p$ decreased as the parasitic patches moved inward because their effective length decreases. When there is no overlap between the parasitic patches and the circular patch (X1≥15 mm), the parasitic patches do not affect the antenna performance ($C_{in}$=0). As X1 changed from 15 to 7 mm, the resonant frequency varied uniformly from 3.02 to 2.7 GHz (10% tuning) with a constant 10 dB return loss bandwidth (approximately 1%). For X1=7 mm, $C_{in}$=5 pF, $C_{out}$=6.4 pF, and $L_p$=0.61 nH. When X1 decreased below 7 mm, $C_{in}$ did not change and $C_{out}$ decreased, therefore, the resonant frequency shifted upward until the parasitic patches completely overlapped the circular patch ($\in_{out}$=0) and no further tuning occurred. Simulations showed that larger resonance tunability, approximately 20%, can be achieved by using a higher dielectric constant ($\in_r$=10.2) substrate for the parasitic patches. Also, larger parasitic patches (radius of 25 mm) used with a larger Hoberman linkage can provide up to 30% resonance tunability with the same circular patch antenna.

Figure 9:
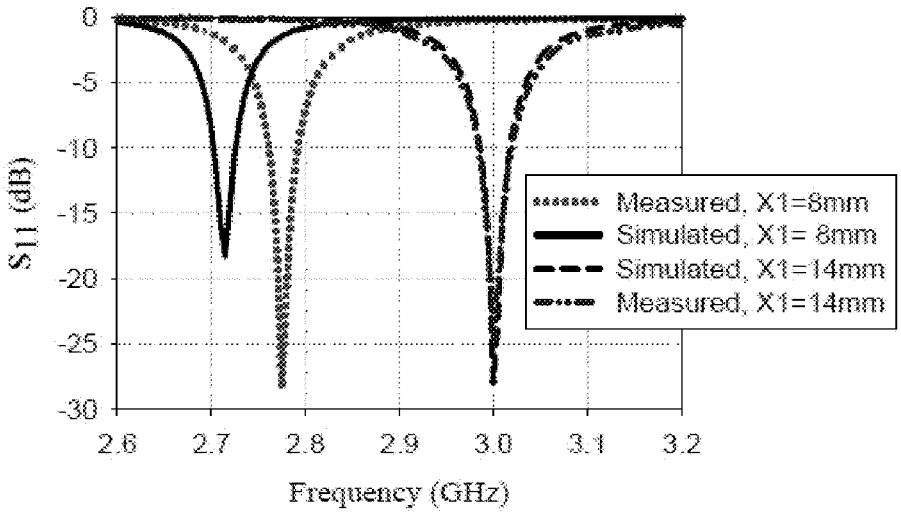
FIG. 9 is a graph of the measured and simulated $S_{11}$ for the prototype antenna for different X1 values in mm.
Figure 10:
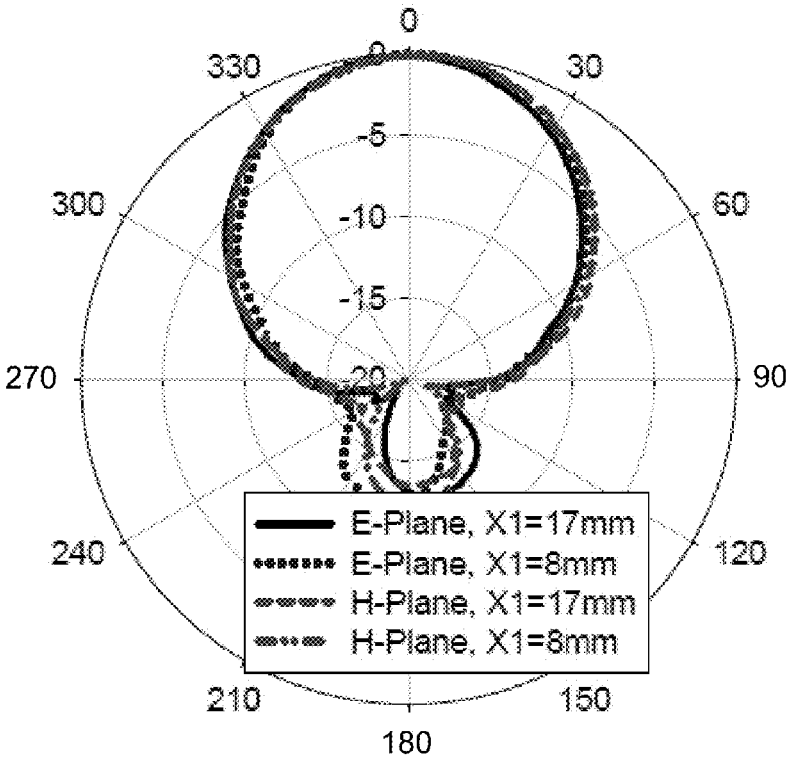
FIG. 10 is a graph of the measured co-pol radiation patterns for the prototype antenna for X1=17 mm at 3.02 GHz, and for X1=8 mm at 2.77 GHz.

A comparison between the HFSS simulations and measured $S_{11}$ for the reconfigurable antenna is given in FIG. 9. The agreement is nearly exact for X1=14 mm. The deviation of 55 MHz for the case of X1=8 mm was due to imperfect control of the gap height between the circular patch and electromagnetically coupled parasitic patches. Ideally, this gap is equal to the thickness of the substrate on which the parasitic patches are formed. The variation in gap height could be reduced by using a more rigid attachment of the quarter-circle patches to the Hoberman linkage. FIG. 10 shows the measured radiation patterns of the mechanically reconfigurable antenna for different values of X1. The patterns are normalized to the maximum gain over the E-plane pattern for X1=17 mm. As can be appreciated from the figure, the movement of the parasitic patches has a minimal effect on the radiation patterns or the gain. The simulated gain was approximately 4.5 dB and the measured front-to-back ratio was approximately 15 dB. The measured maximum co-pol to cross-pol gain ratio remained greater than 25 dB over the tuning range.

Table I shows a comparison between the above-describe design and a hypothetical design with equivalent tunability that is achieved using an ideal (lossless) tunable L-section matching network (MN). The MN that was used comprised a series-shunt capacitor network that was assumed to be connected at the antenna feed point. Even though the MN losses were ignored, the simulated gain and 10 dB return loss bandwidth decreased due to operation of the antenna away from its natural resonant frequency. For a microstrip antenna, off-resonance operation decreases the gain due to the rapid decrease in the radiation resistance. For the same reason, and because of the increase in the imaginary part of the input impedance, the return loss bandwidth decreases. In this example, there was nearly a 50% reduction in bandwidth, which may be unacceptably large depending on the application. Alternative tunable matching network configurations, such as 7-networks, may yield comparable return loss bandwidths but may not mitigate the gain reduction problem.

TABLE I

COMPARISON BETWEEN THE PRESENTED APPROACH AND RESULTS USING AN L-SECTION MATECHING NETWORK (MN)

| Resonant Frequency | BW (%) using MN | BW (%) varying X1 | Gain using MN (dB) | Gain varying X1 |
|---|---|---|---|---|
| 2.85 GHz | 0.6 | 1 | 3.95 | 4.65 dB |
| 2.7 GHz | 0.36 | 0.93 | 2.94 | 4.55 dB |

Figure 11:
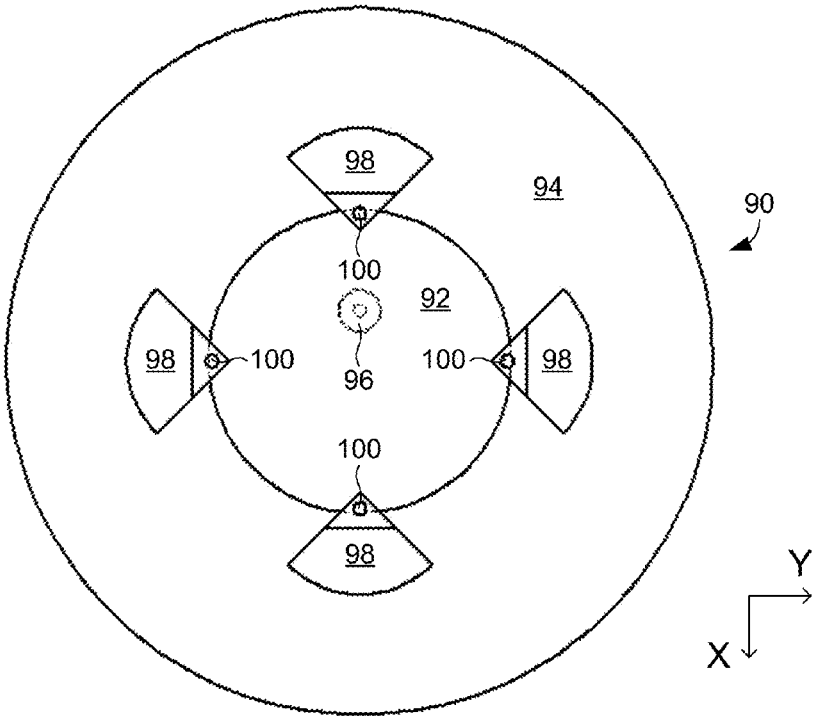
FIG. 11 is a top view of a second embodiment of a mechanically reconfigurable antenna that uses a Hoberman linkage (not shown) to adjust the frequency at which the antenna operates.

A second embodiment of a mechanically reconfigurable antenna was designed by enabling direct contact between the parasitic patches and the circular microstrip patch antenna to increase the resonant frequency tunability range. FIG. 11 illustrates such an embodiment. In this embodiment, a circular microstrip patch antenna 90 comprises a circular patch 92 that is formed on a circular substrate 94. As before, the circular patch 92 is fed by a coaxial probe 96. Quarter-circle parasitic patches 98 are positioned in close proximity to the circular patch 92. In this embodiment, however, electrical contact is made between each of the parasitic patches 98 and the circular patch 92 by vertical interconnects 100, which can slide across the surface of the circular patch 92. Because of the direct contact, the sizes of the parasitic patches 98 can be different than those of the non-contact (electromagnetic coupling) embodiment. By way of example, the radiuses of the parasitic patches 98 can be decreased from 15 mm to 10 mm, and the radiuses of the ground plane can be increased from 25 mm to 35 mm (to keep the ground plane size large enough relative to the radiating area).

Figure 12:
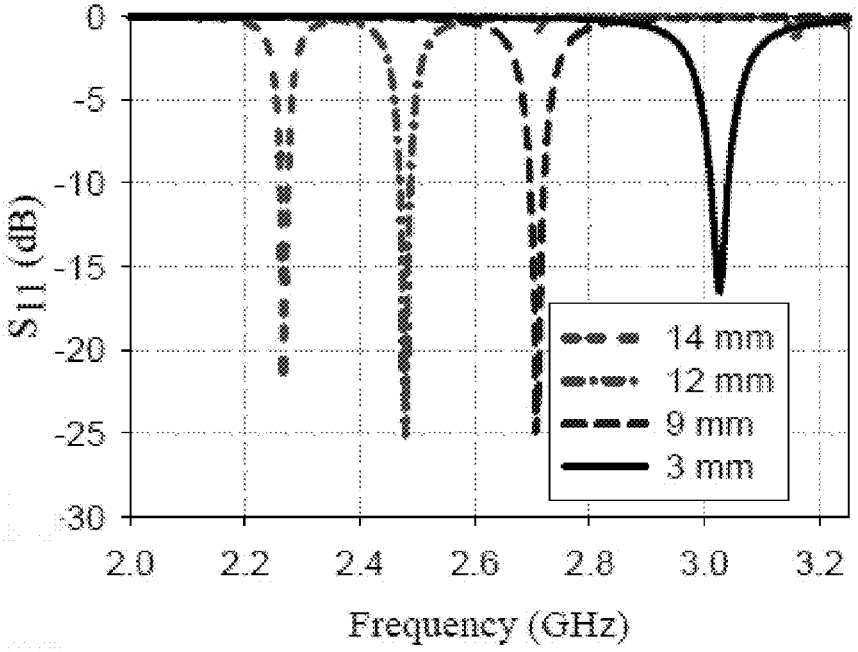
FIG. 12 is a graph of the simulated $S_{11}$ for different X1 values in mm for the antenna of FIG. 11.

FIG. 12 shows the simulated resonant frequency tunability for the direct-contact embodiment. As the parasitic patches 98 slide over the circular patch 92 toward its center, the resonant frequency varies uniformly from 2.25 to 3.02 GHz (26% change). The resonant frequency moves upward as the parasitic patches 98 move toward the center because this movement is equivalent to reducing the effective diameter of the circular patch 92. The parasitic patches 98 have no effect on the resonance when they are completely within the perimeter of the circular patch 92 (X1≤5 mm). As with the non-contact embodiment, the parasitic patches 98 located along the Y axis have the greatest impact on the resonant frequency. Based on the simulated resonant frequency, the approximate resonant wavelength ($\lambda_g/2$) of this configuration as a function of X1 was found to be: $\lambda_g/2=1.4\cdot R_{eff}+12$ mm, within +/−4% for $15\leq R_{eff}\leq 24$ mm, where $R_{eff}=R_c+(R_p-(R_c-X1))$.

Figure 13:
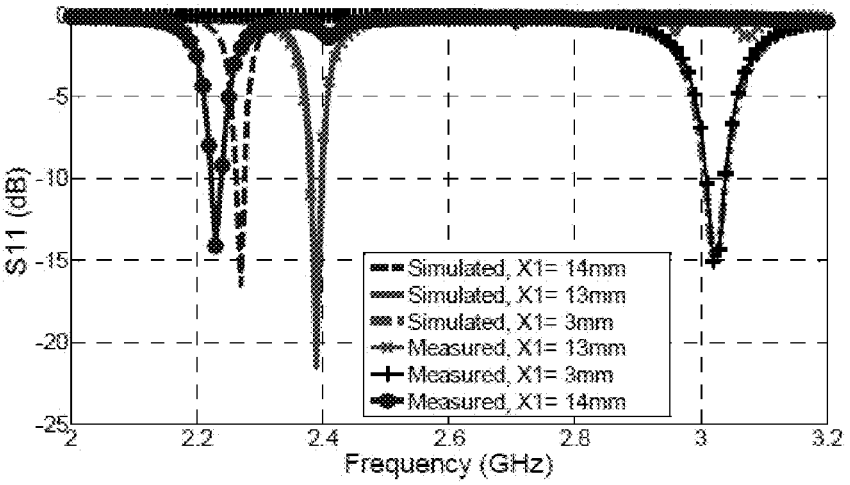
FIG. 13 is a graph of the measured and simulated $S_{11}$ for the antenna of FIG. 11 for different X1 values.

FIG. 13 compares the measured and simulated $S_{11}$ for different X1 values. The difference in the data for X1=14 mm is due to imperfect control of the manual movement (X1 value). As with the non-contact design, greater tunability can be achieved by increasing the size of the parasitic patches, the ground planes, and the Hoberman linkage.

Figure 14:
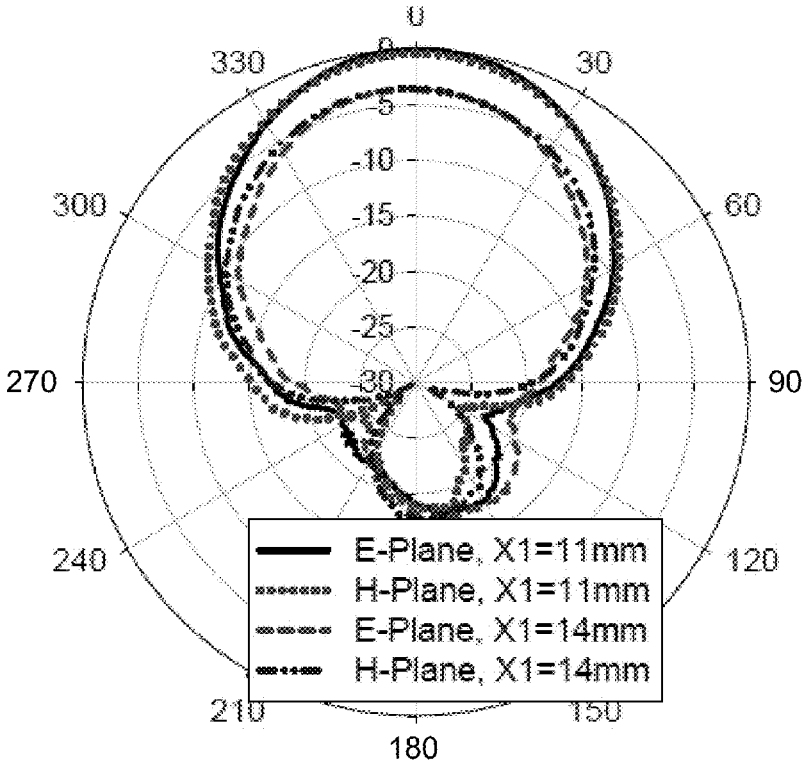
FIG. 14 is a graph of the measured co-pol radiation patterns for the antenna of FIG. 11 for X1=14 mm at 2.23 GHz, and X1=11 mm at 2.62 GHz.

The normalized measured patterns of the direct-contact embodiment for X1=11 mm are shown in FIG. 14. Simulated results show that the peak gain starts to degrade when X1 is larger than 12 mm, and the measurements confirm a drop in gain of 3.2 dB for X1=14 mm. However, as the parasitic patches move away from the center of the circular patch, the ground plane size shrinks relative to the circular patch perimeter and this is the main cause for the gain reduction. Simulated results demonstrate that approximately constant gain is achieved across the tuning range using a ground plane radius of 50 mm. Over the tuning range the measured co-pol to cross-pol gain ratio is greater than 20 dB.

As described in the foregoing disclosure, a new approach for realizing reconfigurable antennas has been developed. Using a planar Hoberman linkage, resonant frequency tunable antennas can be designed. In contrast to an approach using tunable LC matching networks, the presented techniques perform better in terms of maintaining the antenna bandwidth and gain. Using similar foldable mechanisms, various reconfigurable antennas, antenna arrays, and filters can be developed. Digital additive manufacturing is one technique that can be used to produce linkages compatible with small antenna design.

The invention claimed is:

1. A mechanically reconfigurable antenna comprising:

a patch antenna;

one or more parasitic patches; and a radially foldable linkage associated with the patch antenna that can be actuated to move the parasitic patches radially inward and radially outward relative to the patch antenna to change an electromagnetic property of the antenna.

2. The mechanically reconfigurable antenna of claim 1, wherein the patch antenna is a circular patch antenna.

3. The mechanically reconfigurable antenna of claim 1, wherein the patch antenna is positioned within the radially foldable linkage.

4. The mechanically reconfigurable antenna of claim 1, wherein the parasitic patches are quarter-circle patches.

5. The mechanically reconfigurable antenna of claim 1, wherein there are four parasitic patches, two parasitic patches aligned with an X axis of the patch antenna and two parasitic patches aligned with a Y axis of the patch antenna.

6. The mechanically reconfigurable antenna of claim 1, wherein the parasitic patches are electromagnetically coupled to the patch antenna but do not make contact with the patch antenna.

7. The mechanically reconfigurable antenna of claim 1, wherein the parasitic patches are electrically coupled to the patch antenna and make direct contact with the patch antenna.

8. The mechanically reconfigurable antenna of claim 1, wherein the radially foldable linkage is a planar Hoberman linkage.

9. The mechanically reconfigurable antenna of claim 8, wherein the planar Hoberman linkage comprises an upper linkage element, a lower linkage element, and pins that connect the two elements, wherein the elements can radially expand or collapse.

10. The mechanically reconfigurable antenna of claim 9, wherein the patch antenna is positioned between the upper and lower linkage elements.

11. The mechanically reconfigurable antenna of claim 10, wherein the Hoberman linkage further comprises an upper ring and a lower ring, wherein the upper and lower linkage elements are positioned between the upper and lower rings and wherein the rings comprise inner openings through which the pins pass.

12. The mechanically reconfigurable antenna of claim 11, wherein rotation of one of the rings relative to the other ring urges the pins radially inward or outward, which causes radial collapsing or expanding of the linkage elements, which causes inward or outward radial movement of the parasitic patches.

13. A mechanically reconfigurable antenna comprising:

a planar Hoberman linkage including an upper ring, a lower ring, an upper linkage element, and a lower linkage element, the upper and lower rings each comprising an inner opening, the upper and lower linkage elements being radially expandable and collapsible;

pins mounted to the upper and lower linkage elements that connect the linkage elements together, the pins also extending into the inner openings of the upper and lower rings;

a circular microstrip patch antenna associated with the planar Hoberman linkage; and parasitic patches mounted to at least one of the linkage elements in proximity to the patch antenna;

wherein rotation of one of the rings relative to the other ring urges the pins to radially inward or outward, which causes radial collapsing or expanding of the linkage elements, which causes inward or outward radial movement of the parasitic patches relative to the patch antenna so as to change an operating frequency of the antenna.

14. The mechanically reconfigurable antenna of claim 13, wherein the patch antenna is positioned between the upper and lower linkage elements.

15. The mechanically reconfigurable antenna of claim 13, wherein the parasitic patches are electromagnetically coupled to the patch antenna but do not make contact with the patch antenna.

16. The mechanically reconfigurable antenna of claim 13, wherein the parasitic patches are electrically coupled to the patch antenna and make direct contact with the patch antenna.

17. A method for adjusting an electromagnetic property of an antenna, the method comprising:

associating a radially foldable linkage with a patch antenna, wherein parasitic patches are mounted to the linkage; and actuating the linkage in a manner in which the parasitic patches move radially inward or outward relative to the patch antenna.

18. The method of claim 17, wherein the radially foldable linkage is a planar Hoberman linkage.

19. The method of claim 17, wherein the parasitic patches are electromagnetically coupled to the patch antenna but do not make contact with the patch antenna.

20. The method of claim 17, wherein the parasitic patches are electrically coupled to the patch antenna and make direct contact with the patch antenna.

* * * * *